US008272153B2

(12) United States Patent
Elizondo, Jr.

(10) Patent No.: US 8,272,153 B2
(45) Date of Patent: Sep. 25, 2012

(54) WALL-MOUNTED SELF-STORING CENTER-ROTATION IRONING BOARD

(76) Inventor: Baldemar Elizondo, Jr., Broken Arrow, OK (US)

( * ) Notice: Subject to any disclaimer, the term of this patent is extended or adjusted under 35 U.S.C. 154(b) by 512 days.

(21) Appl. No.: 12/420,636

(22) Filed: Apr. 8, 2009

(65) Prior Publication Data

US 2010/0257762 A1 Oct. 14, 2010

(51) Int. Cl.
*D06F 81/06* (2006.01)
*D06F 81/00* (2006.01)

(52) U.S. Cl. ..... 38/137; 38/139; 108/48

(58) Field of Classification Search ..... 38/103, 38/104, 112, 137–139; 108/42, 48; 248/447.1, 248/447.2
See application file for complete search history.

(56) References Cited

U.S. PATENT DOCUMENTS

| | | | | |
|---|---|---|---|---|
| 667,164 | A * | 1/1901 | Carder | 108/39 |
| 1,455,446 | A | 5/1923 | Montgomery | |
| 1,596,185 | A * | 8/1926 | Hurst | 108/39 |
| 1,765,343 | A | 6/1930 | Madsen | |
| 1,858,765 | A | 5/1932 | Cramer | |
| 2,014,549 | A | 9/1935 | Behm | |
| 2,263,609 | A | 11/1941 | Bullard | |
| 2,517,256 | A * | 8/1950 | Summers | 108/39 |
| 2,535,755 | A | 12/1950 | Rieter | |
| 3,244,126 | A * | 4/1966 | Hildreth | 108/48 |
| 4,480,556 | A | 11/1984 | Wilson et al. | |
| 4,995,681 | A * | 2/1991 | Parnell | 312/242 |
| 6,684,540 | B1 | 2/2004 | Tufts | |
| 7,062,871 | B1 * | 6/2006 | Smidt | 38/104 |

* cited by examiner

*Primary Examiner* — Ismael Izaguirre
(74) *Attorney, Agent, or Firm* — Gable Gotwals

(57) ABSTRACT

A wall-mounted, self-storing ironing board includes an elongated ironing platform connected to a turntable by a pivot pin located approximately at a center point of the platform, thereby providing a full 360° rotation of the platform when the ironing board is in the horizontal use position. Rotation of the platform 90° clockwise or counterclockwise relative to the turntable allows the user to stand directly opposite either end of the platform and to use either end in ironing an article of clothing. In another embodiment, the pivot pin is located forward of a linkage that connects the turntable to a wall-mounted casing and allows for the turntable to move between a vertical stored position and the horizontal use position.

3 Claims, 5 Drawing Sheets

WALL-MOUNTED SELF-STORING CENTER-ROTATION IRONING BOARD

BACKGROUND OF THE INVENTION

This invention relates generally to ironing boards and more particularly concerns wall-mounted, self-storing ironing boards.

Known wall-mounted, self-storing ironing boards typically have a wooden or plastic casing sized to fit into the space between household wall studs which typically are on 16" centers or the casing is sized for surface mounting. The casing is covered by a hinged door. A linkage is hinged between the lower portion of the ironing platform and the bottom of the casing. A steel rod fixed to the lower end of the platform has ends which are disposed in vertical tracks in lower portions of the side walls of the casing. When the platform is lowered into its horizontal use position or raised into its vertical storage position, the ends of the steel rod slide in frictional engagement in the tracks.

One major problem with these known self-storing ironing boards is that the rotation of the ironing platform when in the horizontal use position is limited to 180° or less. This limitation is troublesome for a user because it prevents full use of both ends of the ironing platform. While an article of clothing may be laid on the ironing platform at the end located nearest the casing—which is typically the broader end of the ironing platform—the clothing cannot envelope the end so that a top or bottom layer of the clothing may be ironed. To achieve 90° clockwise and counterclockwise rotation of the ironing platform, the casing must be positioned at least one length of the ironing platform from adjacent walls or objects located right and left of the casing. Because this left-to-right spacing is equal to twice the length of the board, in many residential laundry rooms rotation of the ironing platform in the clockwise or counterclockwise direction is limited to less than 90°, thereby preventing the user from standing opposite either or both ends of the ironing platform and further reducing the already limited functionality of the end nearest the casing. In many cases, this also limits the functionality of the end of the ironing platform directly opposite to or located near the casing. Last, because only one end of the ironing platform is fully functional for ironing purposes, users who confront space limitations to the left or right of the casing must often compromise on the location of the ironing board. This is especially troublesome in applications in which one user irons right-handed and another user irons left-handed.

It is, therefore, an object of this invention to provide a wall-mounted, self-storing ironing board which provides full, 360° horizontal rotation of the ironing platform. Another object of this invention is to provide a wall-mounted, self-storing ironing board that allows full access to, and functionality of, both ends of the ironing platform. A further object of this invention is to provide a wall-mounted, self-storing ironing board that allows a user to stand opposite either end of the ironing platform without being interfered with by the casing or the wall to which the casing has been mounted. Another object of this invention is to provide a wall-mounted, self-storing ironing board that limits the space requirements needed for horizontal rotation of the ironing platform. Yet another object of this invention is to provide a wall-mounted, self-storing ironing board that allows a user to stand in essentially the same location when ironing over one end of the ironing platform, rotate the platform when done with that end, and then iron using the other end. A further object of this invention is to provide a wall-mounted, self-storing ironing board that does not limit use of ironing platform by right-handed and left-handed users because of its particular location on a wall.

SUMMARY OF THE INVENTION

In accordance with the invention, a wall-mounted, self-storing, center-rotation ironing board is provided which has a shallow, narrow, open fronted casing, a turntable, and an elongated platform that extends along a lengthwise axis and has one end portion overlapping the turntable. A linkage in hinged relationship to the turntable and casing provides for rotation of the turntable between an almost vertical storage position with the platform contained in the casing and a horizontal ironing position in which the platform extends forwardly from the casing. A pivot pin connects the platform to the turntable for rotation in the horizontal plane. In one embodiment, the pivot pin is located along the lengthwise axis of the platform at about the center point of the platform lengthwise. Locating the pivot point of the platform at its approximate center point provides a full 360° rotation of the platform when the ironing board is in the horizontal use position. Rotation of the platform 90° clockwise or counterclockwise relative to the turntable allows a user to stand directly opposite either end of the platform and to use either end in ironing an article of clothing. In another embodiment, the pivot pin is located along the lengthwise axis of the platform and forward of the hinge that connects the linkage to the turntable.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
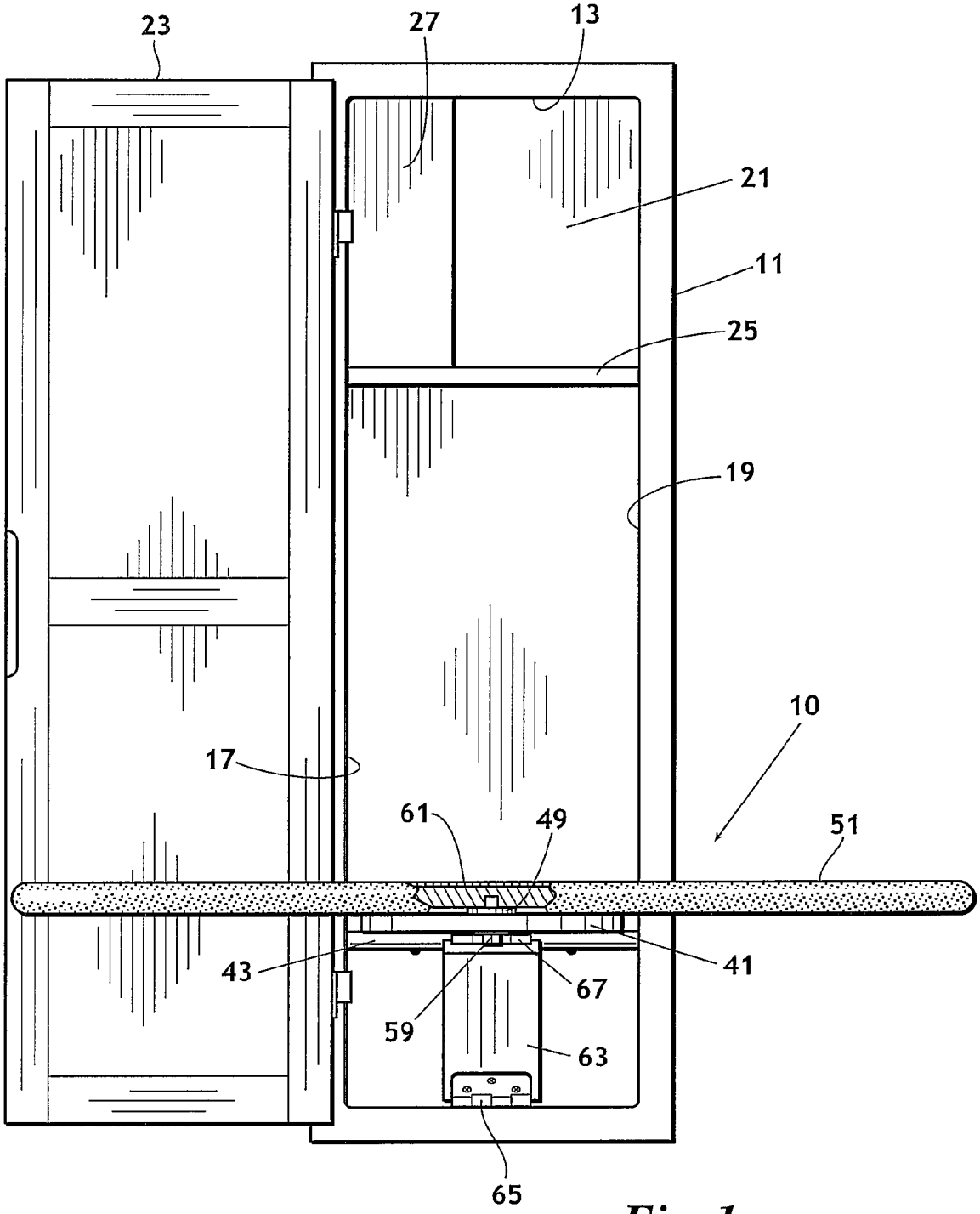
FIG. 1 is a front elevation view of a preferred embodiment of the wall mounted self-storing center-rotation ironing board illustrating the ironing platform rotated 90° relative to the longitudinal axis of the supporting turntable.
Figure 2:
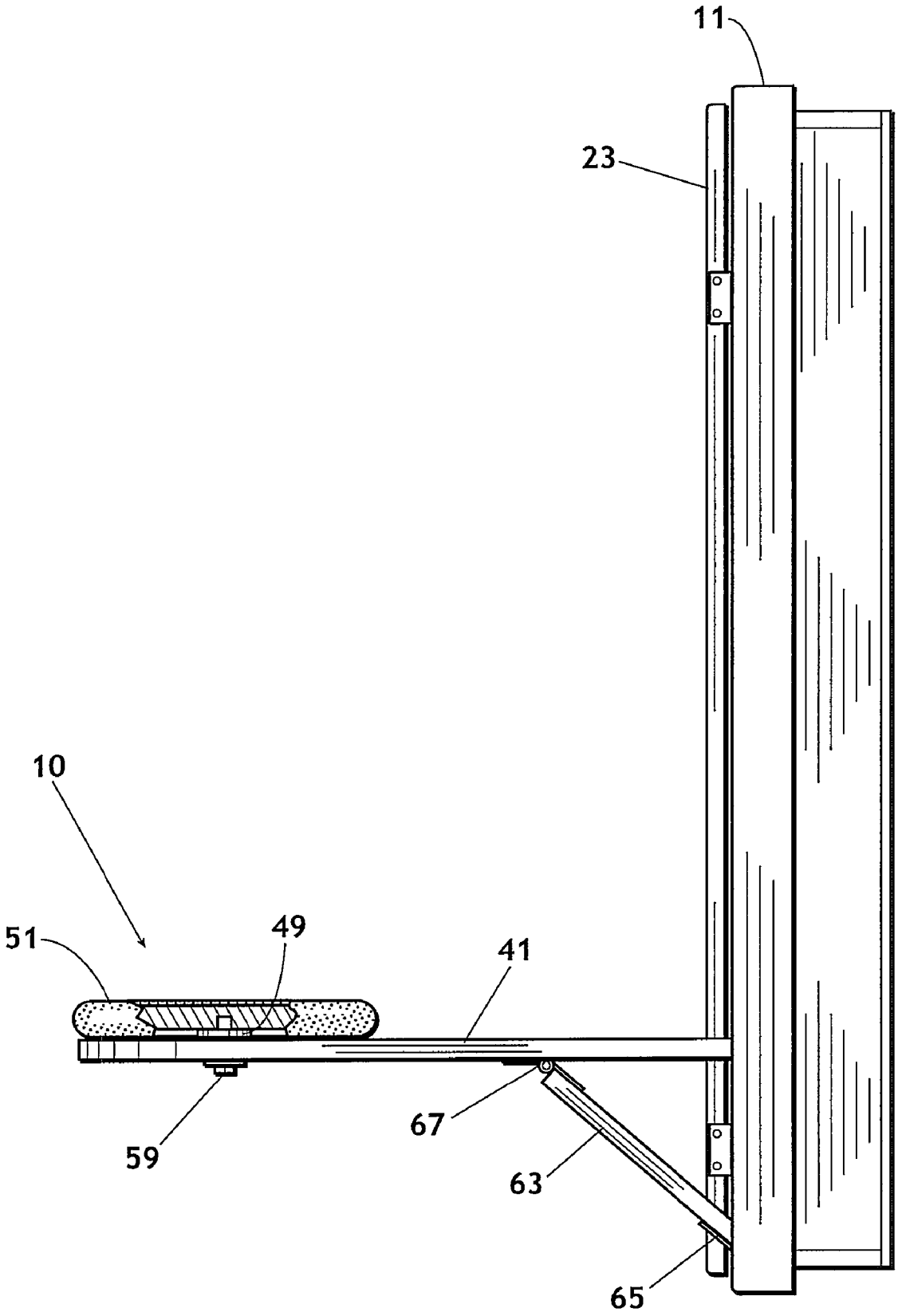
FIG. 2 is a right side elevation view of the ironing board of FIG. 1.

Turning first to FIGS. 1 and 2, a wall-mounted, self-storing ironing board 10 is illustrated. The ironing board 10 consists of a casing 11 having a top wall 13, a bottom wall 15, left and right side walls 17 and 19 and a back wall 21. The board 10 also has an open front which may be closed by a door 23. The casing 11 is sized to be so shallow and narrow as to fit in the space between residential wall studs with the back of the door 23 flush against the front of the residential wall. Alternatively, casing 11 may be configured for surface mount to back wall 21. A shelf 25 is provided in the upper portion of the ironing board 10 to support an iron and supplies associated with ironing (not shown). Preferably, the shelf space intended for storage of the iron is protected by a heat shield 27 guarding the portions of the side wall 17 and back wall 21 above the shelf 25. The side walls 17 and 19 typically have inverted L-shaped tracks (not shown) routed in their inner faces that receive a rod 43.

Returning to FIG. 1, the preferred embodiment of the ironing board 10 has a turntable 41 which fits into the lower portion of the cavity in the casing 11. The turntable 41 has a rod 43 fixed to its lower end, such as by screws (not shown). The rod 43 extends horizontally across the casing 11 and the ends of the rod 43 are slidably disposed in tracks in the side walls 17 and 19 of the casing 11. The tracks may include a plastic insert in order to reduce the frictional forces encountered by the ends of rod 43 as rod 43 slides within the tracks.

Figure 5:
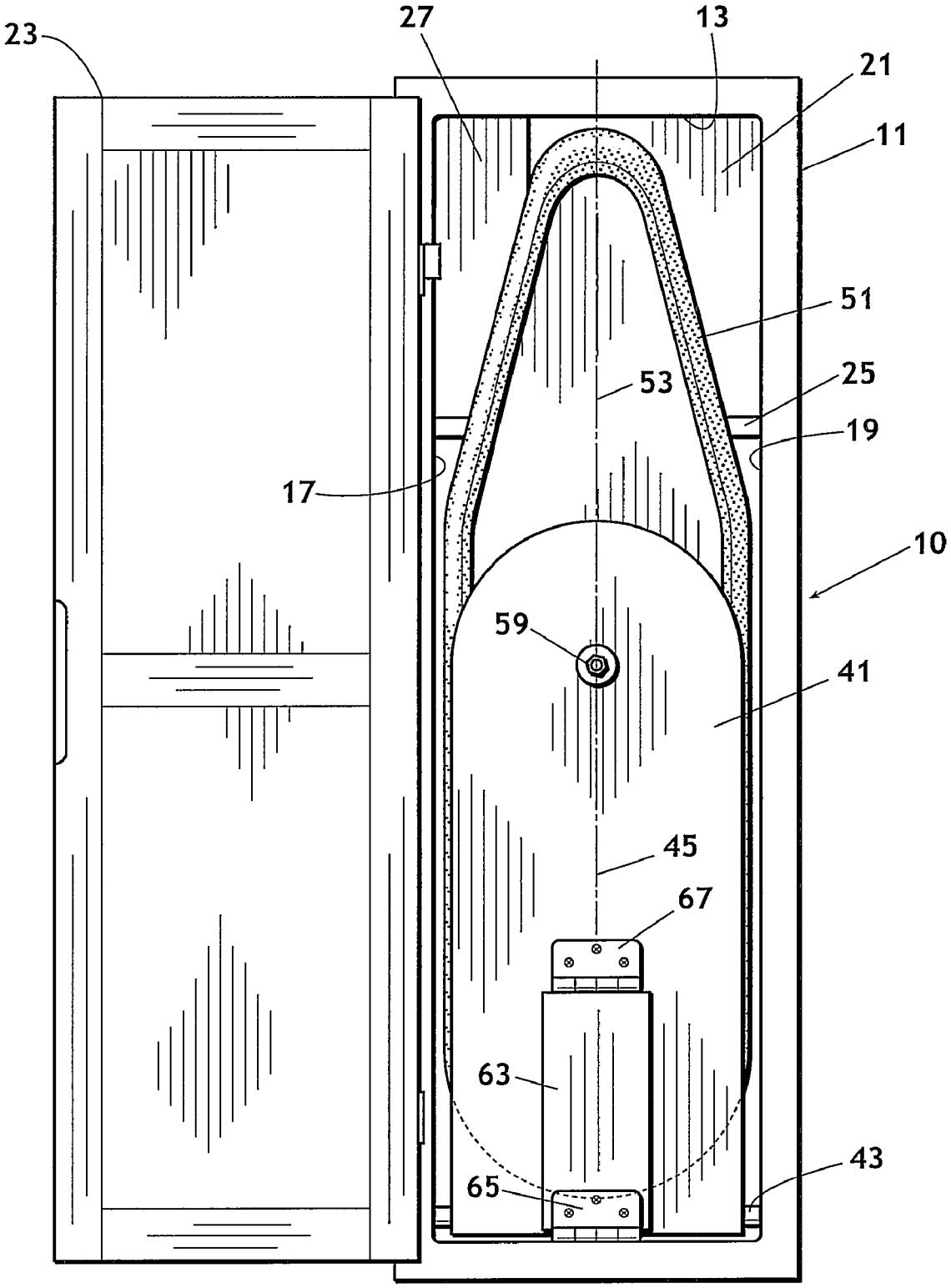
FIG. 5 is a front elevation view of the ironing board of the ironing board of FIG. 1 in the stowed position.

An elongated ironing platform 51 extends along a longitudinal axis 53. The platform 51 is shaped to fit comfortably within the casing 11 and, as best seen in FIG. 5, one end 55 or 57 of the platform 51 overlaps the turntable 41 when the longitudinal axis 53 of platform 51 is aligned with a longitudinal axis 45 of turntable 41. A spacer 49, which is relatively small in comparison to the overlapped area of the turntable 41 and platform 51, may be disposed between the turntable 41 and the platform 51 to facilitate passage of the hem of an ironing board cover between the turntable 41 and the platform 51.

Figure 4:
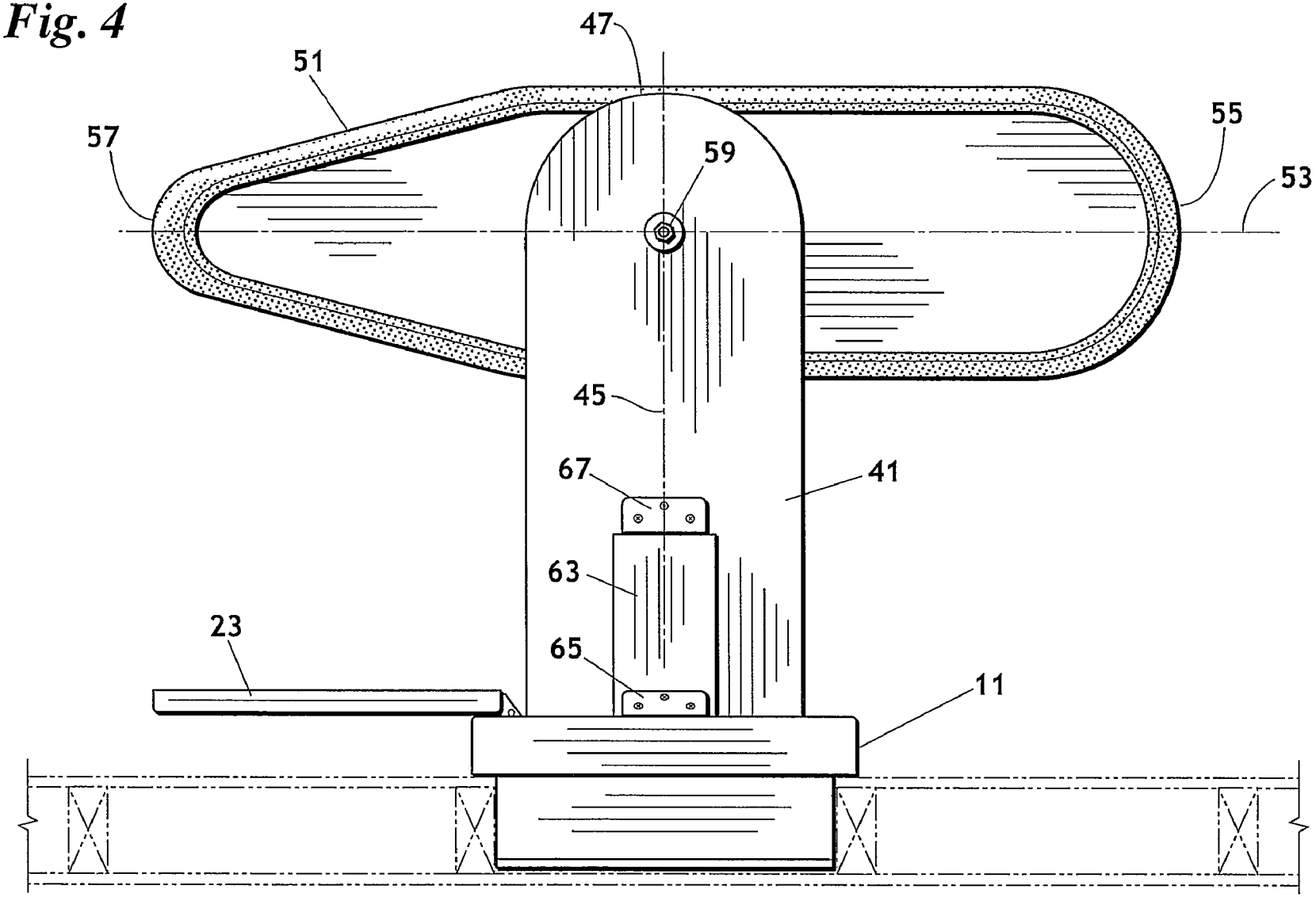
FIG. 4 is a bottom plan view of the ironing board of FIG. 1.

A pivot pin 59 such as a bolt and nut combination extends through the turntable 41 and the platform 51. This arrangement permits the platform 51 to be rotated horizontally on the turntable 41 by manual application of a rotating force to the platform 51. However, the bolted relationship of the components prevents inadvertent rotation of the platform 51 in relation to the turntable 41. As illustrated in FIG. 4, the forward or upper end 47 of the turntable 41 and the rear or bottom end 55 of the platform 51 are cut to form a circle so that, as the platform 51 is rotated on the turntable 41, the exposed edges will always be smooth.

As best seen in FIGS. 2 and 4, a linkage 63 has one end connected by a first hinge 65 to the bottom wall 15 of the casing 11 and another end connected by a second hinge 67 toward the forward end 47 of the turntable 41. The linkage 63 may provided with a hole (not shown) to accommodate the nut of pivot pin 59 when the platform 51 is stored as shown in FIG. 5.

Looking at FIGS. 1 to 5 the operation of the ironing board 10 can be understood. In FIG. 5, the ironing board 10 is shown with the platform 51 in its almost vertical storage position in the casing 11. The turntable 41 and linkage 63 are collapsed and the rod 43 is at the lowest point in its path of travel sliding in the tracks. The center of gravity of the hinged components taken together, including the platform 51, turntable 41 and linkage 63, are preferably to the rear of the pivot axis of the first hinge 65. If the center of gravity passes behind the pivot axis of the hinge 65, the tendency of the combined components will be to rotate into the casing 11 under the force of gravity to hold the platform 51 in abutment with the shelf 25. Additionally, the frictional forces resulting from the sliding motion of the rod 43 in the tracks are preferably such that these forces do not overcome the gravitational force and prevent free, unassisted rotation into abutment with the shelf 25.

Turning now to FIGS. 1 to 4, the platform 51 is illustrated in its horizontal position for use in ironing. To transfer the stored platform 51 illustrated in FIG. 5 to its horizontal position, the upper stored end 55 or 57 of the platform 51 is pulled outwardly and downwardly. This causes the linkage 63 to hinge with respect to the bottom wall 15 of the casing 11 and the turntable 41. As the hinges 65 and 67 rotate, the rod 43 slides upwardly in tracks until the rod 43 engages the upper ends of the tracks. This secures the platform 51 in its horizontal use position. In returning the platform 51 into its stored position, upward force on the forward portion of the platform 51 causes the hinges 65 and 67 to operate. The rod 43 shifts rearwardly into the vertical portions of the tracks and then slides downwardly in the tracks under the continued application of manual force against the platform 51. Depending on the coefficient of friction between the rod 43 and the tracks, the platform may rotate without further application of manual force into its almost vertical stored position when the center of gravity crosses over the pivot axis of the first hinge 65.

Figure 3:
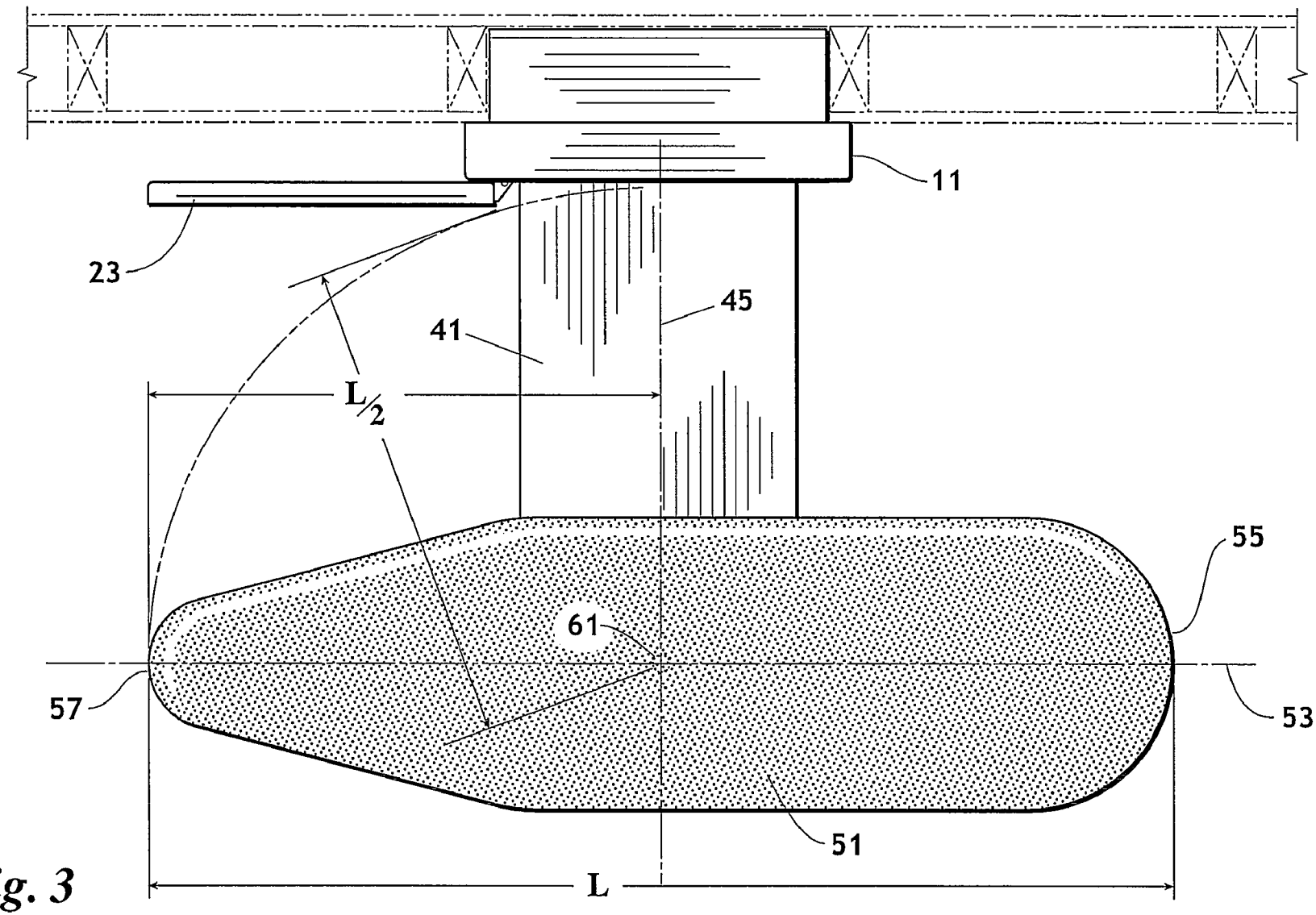
FIG. 3 is a top plan view of the ironing board of FIG. 1, which may be mounted between wall studs (as shown) or to the wall surface, illustrating the rotation of the ironing platform about its approximate center point.

As can best be seen in FIGS. 1 to 4, in the horizontal use position platform 51 can be rotated horizontally about the pivot pin 59 so that the angular position of the platform axis 53 can be changed in relation to the casing 11. Because pivot pin 59 is located at or near a center point of platform 51—the approximate location of the center point being indicated by element number 61 (see FIG. 3)—a full 360° rotation of platform 51 may be achieved when platform 51 is in the horizontal use position. As best seen in FIG. 5, when platform 51 is moved between the vertical storage position and its horizontal use position, the longitudinal axis 53 of the platform 51 and the longitudinal axis 45 of the turntable 43 are substantially aligned and parallel one another. Unlike prior art ironing boards, which pivot about or near the bottom end 55 of platform 51 and therefore restrict user access to bottom end 55, rotating the platform 51 90° clockwise or counterclockwise from the initial horizontal use position allows full access to, and functionality of, both ends 55 and 57 of platform 51 (see e.g,. FIGS. 2 & 3). A user may stand opposite either end 55, 57 of platform 51 without being interfered with by the casing 11 or the wall to which casing 11 has been mounted. Portions of the upper surface of turntable 41 also are exposed and may be used to temporarily store articles of clothing or ironing supplies. The centrally rotated platform 51 also allows a user to stand in essentially the same location when ironing over one end 55 or 57 of the platform 51, rotate the platform 51 180° degrees when done, and then iron using the other end 57 or 55. Last, centrally rotated platform 51 limits the space requirements needed for horizontal rotation of platform 51. Prior art ironing boards require a full length "L" of platform 51 for rotation of the platform 51 left or right of the casing 11. The centrally rotated platform 51 requires one half the length L of the platform 51 to accomplish this same rotation.

Thus, it is apparent that there has been provided, in accordance with the invention, a wall-mounted, self-storing, centrally rotated ironing board that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A wall-mounted, self-storing ironing board comprising:

an open-fronted casing having opposed interior vertical tracks in side walls thereof;

a horizontal rod having ends engaged for vertical and angular reciprocation in said tracks;

an elongated turntable having a longitudinal axis perpendicular to said rod, said turntable being fixed at a rear end thereof to said rod for vertical and angular reciprocation with said rod;

a linkage pivotally connected between said casing and said turntable and permitting said angular reciprocation of said turntable between an almost vertical storage position in said casing and a cantilevered horizontal ironing position extending from said casing;

an elongated platform having a longitudinal center axis and having one end portion thereof overlapping said turntable; and a pivot pin connecting said platform to said turntable for rotation in a plane parallel thereto, said pivot pin being located along said longitudinal center axes and forward of said linkage.

2. A wall-mounted, self-storing ironing board according to claim 1, comprising said pivot pin being located approximately at a lengthwise center point of said platform.

3. A wall-mounted, self-storing ironing board according to claim 2, said location of said pivot pin permitting 360° rotation of said platform in relation to said turntable.

* * * * *